US005113227A

United States Patent [19]

Miyasaka

[11] Patent Number: 5,113,227

[45] Date of Patent: May 12, 1992

[54] WASTE TONER CONVEYING APPARATUS

[75] Inventor: Toshiaki Miyasaka, Tokyo, Japan

[73] Assignee: Mutoh Industries Ltd., Tokyo, Japan

[21] Appl. No.: 545,898

[22] Filed: Jun. 29, 1990

[30] Foreign Application Priority Data

Dec. 25, 1989 [JP] Japan ..... 1-336113

[51] Int. Cl.[5] ..... G03G 21/00

[52] U.S. Cl. ..... 355/298; 198/674; 222/DIG. 1

[58] Field of Search ..... 355/298; 222/DIG. 1, 222/333, 413; 198/657, 660, 659, 674; 141/86, 88, 311 A, 363, 364

[56] References Cited

U.S. PATENT DOCUMENTS 2,541,742 2/1951 Booth ..... 198/674 X
4,218,126 8/1980 Takeichi ..... 222/413 X
4,826,361 5/1989 Merz ..... 198/674 X
4,943,830 7/1990 Sulenski ..... 222/DIG. 1 X
4,958,196 9/1990 Fujii et al. ..... 355/298

*Primary Examiner*—A. T. Grimley
*Assistant Examiner*—Shuk Y. Lee
*Attorney, Agent, or Firm*—Wenderoth, Lind & Ponack

[57] ABSTRACT

A waste toner conveyer of an image forming apparatus has a screw for conveying powdery toner along a toner conveying passage defined in the conveyer. The screw includes a plurality of strip-like spring members which are reciprocally moved along a longitudinal direction of the waste toner conveyer. The screw is secured to a rotary shaft. A pin fixed to the shaft rotates and slides along an irregular surface of a cam so as to reciprocate the screw horizontally during the rotation of the shaft. Accordingly, waste toner is shaken from the screw by an extension and retraction of the screw along the longitudinal axis so that such waste toner can fall through a waste toner outlet.

4 Claims, 2 Drawing Sheets

WASTE TONER CONVEYING APPARATUS

BACKGROUND OF THE INVENTION

The present invention relates to a waste toner conveying mechanism of an image forming apparatus and the like.

A conventional image forming apparatus described, for example, in Japan Patent Publication Sho. 63-32192, has a waste toner recovery device in which powdery toner attached to an image forming body, such as a photosensitive drum and the like, is scraped into a case or container of a toner conveying apparatus by a blade. A screw arranged in the toner conveying apparatus is rotated and consequently, the toner is conveyed to an outlet of the waste toner recovery device.

In the conventional waste toner recovery device, powdery toner is apt to attach to the screw, and toner is apt to become deposited on or to accumulate on a portion of the device, so that it is difficult to smoothly discharge the toner through a toner outlet.

SUMMARY OF THE INVENTION

Accordingly, it is an object of the present invention to solve the shortcoming of the above conventional toner recovery apparatus by providing a unique waste toner conveying mechanism.

DETAILED DESCRIPTION OF THE PREFERRED EMBODIMENT

The waste toner conveying apparatus according to the present invention will now be explained with reference to the accompanying drawings.

Figure 1:
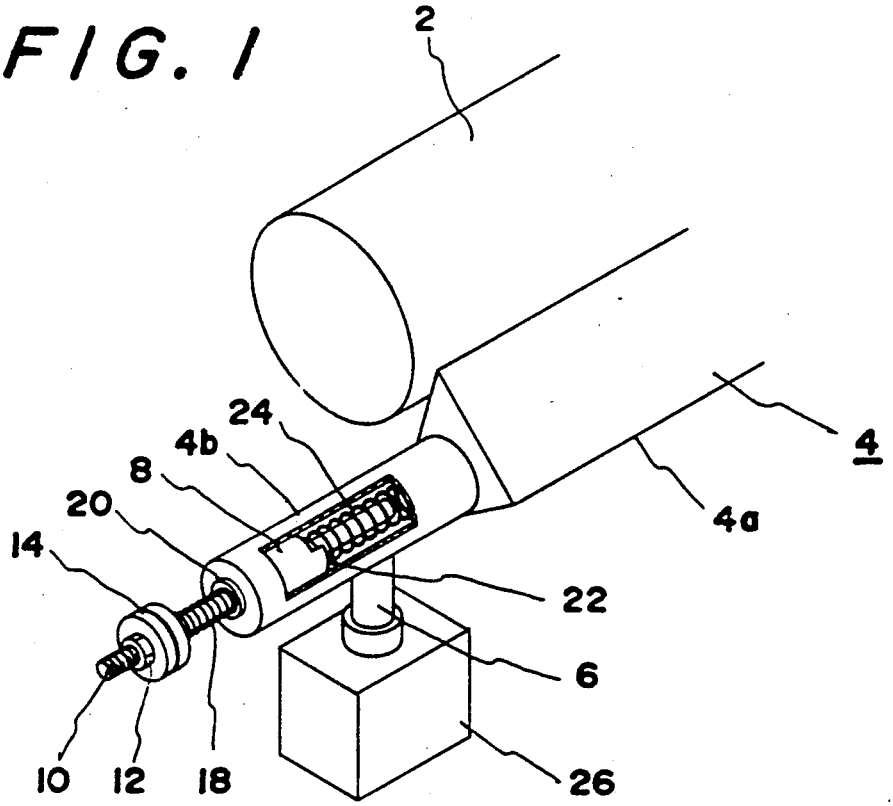
FIG. 1 a perspective view of a waste toner conveying apparatus according to the present invention.
Figure 2:
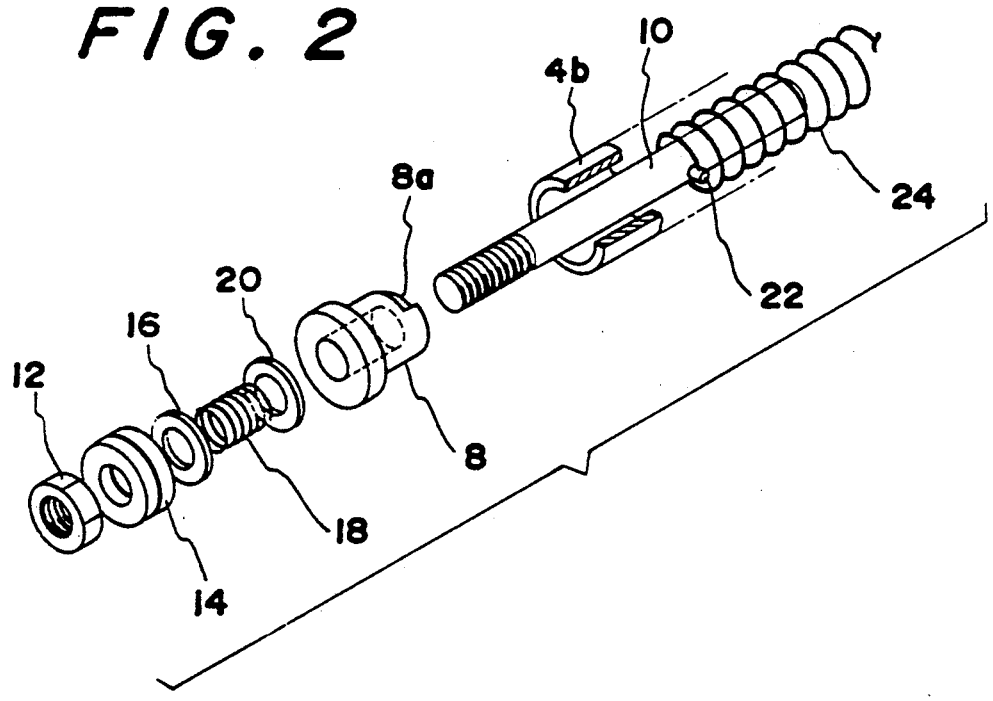
FIG. 2 is a perspective assembly view of various parts of the waste toner conveying apparatus shown in FIG. 1.

As shown in FIG. 1, an image forming body 2 consisting of a photosensitive drum or a magnetic drum of an image forming apparatus is supported on the machine frame so as to be rotated by a rotary drive device. The machine frame has a waste toner conveying apparatus 4 arranged adjacent to the image forming body 2. A conveyer pipe 4*b* is fixed to one end of the case 4*a* of the waste toner conveying apparatus so as to define a housing in which the toner is conveyed, and the conveying pipe 4*b* has a toner outlet 6 fixed to the under surface of the toner conveying pipe 4*b*. A cam 8 is inserted into and is secured to an end of the toner conveying pipe 4*b* and defines a concavo-convex cam face 8*a* disposed within the end portion of the toner conveying pipe 4*b*. The cam 8 has a central hole through which a shaft 10 is slidably inserted. One end portion of the shaft 10 extends from the waste toner conveying pipe 4*b* and the another end portion extends into the interior of the pipe 4*b*. A nut 12 is threaded to or engaged with a threaded portion of the shaft 10 at the outward-extending end of the shaft 10. A ball bearing 14, a washer 16, a compressed coil spring 18, and a washer 20 are slidably arranged on the outward-extending end of the shaft 10 between the nut 12 and the cam 8. A fixing pin 22 extends from the inward end of shaft 10, which pin 22 is urged into contact with the cam face 8*a* by the resilient force of the coil spring 18. A screw 24 of the waste toner conveying apparatus 4 consists of a plurality of strip-like spring plates. One end of the screw 24 is connected to an end of the case 4*a* containing a rotary drive mechanism and thus the screw 24 is rotatably fixed to a rotary shaft (not shown) supported on the machine frame. The other end of the screw 24 extends over the outer circumferential face of the shaft 10 and is secured to the pin 22. A box-like waste toner container 26 has an upper opening which is connected to the toner outlet 6 of the waste toner conveying pipe 4*b*.

The operation of the waste toner conveying apparatus according to the present invention will be explained with reference to the accompanying drawings.

Figure 3:
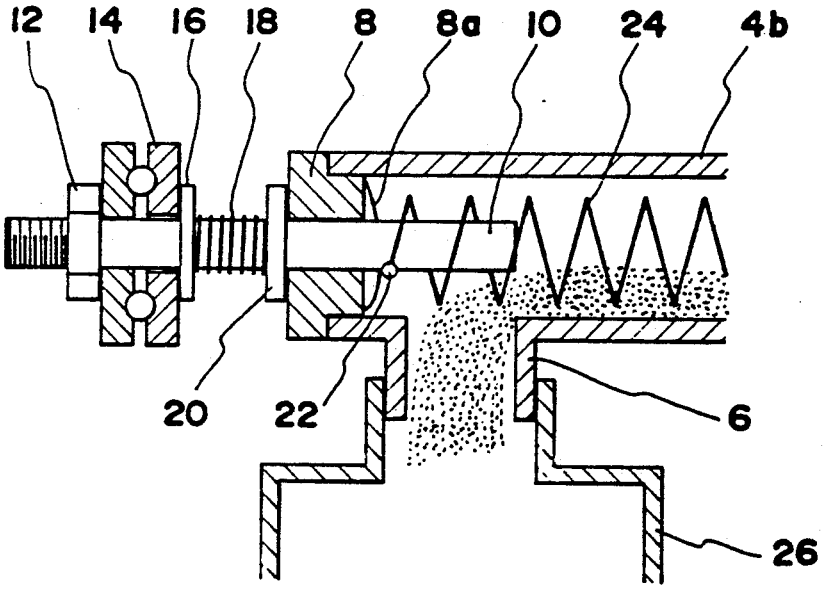
FIG. 3 is a sectional view of the waste toner conveying apparatus.

First of all, during the operation of the image forming apparatus, powdery toner attached to the image forming body 2 is scraped therefrom by a blade and drops into the case 4*a* of the waste toner conveying apparatus 4. The rotary driving system or mechanism rotates the screw 24 so that the rotating screw 24 conveys the powdery toner within the case 4*a* and the toner conveying pipe 4*b* to the toner outlet 6. The powdery toner drops into the toner container 26 through the toner outlet 6 after the toner has been conveyed through the toner conveying pipe 4*b* by means of the screw 24. The shaft 10 rotates together with the rotation of the screw 24, and the pin 22 moves or rotates along the cam face 8*a* (irregular surface) of the cam 8 while being urged into contact with the cam face 8*a*. As the pin 22 rotates or slides along the concavo-convex cam face 8*a* of the cam 8, it is displaced longitudinally of the shaft 10, so that the shaft 10 having the pin 22 fixed thereto moves reciprocally along its longitudinal axis. As a result, the screw 24 fixed to the shaft 10 through the pin 22 extends and retracts, and the extension and retraction movement of the screw 24 vibrates and shakes off the powdery toner attached thereto, so that the toner will drop from the screw 24 into the waste toner container 26. Owing to the longitudinal extension and retraction of the screw 24, the toner deposited and accumulated around the toner outlet 6 is agitated and is flung about the interior of the toner conveying pipe 4*b* whereby the soft toner drops into the waste toner container 26 as shown in FIG. 3.

Figure 4:
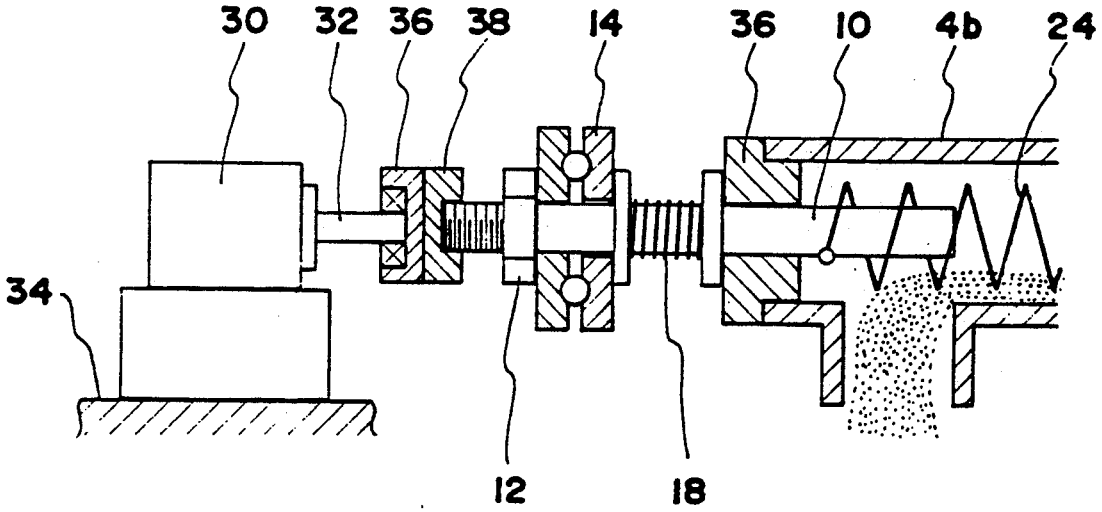
FIG. 4 is a sectional view of an essential part of a conventional waste toner conveying apparatus.

According to the embodiment of the waste toner conveying apparatus of the present invention described above, the shaft 10 is moved along its longitudinal axis in a reciprocal manner by the pin 22 urged with the resiliency into contact with the irregular face of the cam 8. Thus, the screw 24 consisting of strip-like spring plates is extended and retracted along the longitudinal axis of the shaft 10. However, it is possible to connect an output shaft 32 of a solenoid 30, ON-OFF controlled by a controller, to the shaft 10 in order to move the shaft 10 reciprocally along its longitudinal axis as shown in FIG. 4. The solenoid 30 is secured to a base plate 34, and the output shaft 32 is connected to the end of the shaft 10 through a bearing 36 and a flange 38 so as to rotate and move together with the shaft 10. In the embodiment shown in FIG. 4, the shaft 10 is rotatably supported by the waste toner conveying pipe 4*b* through a bearing member 36 attached to the end of the pipe 4*b*. The structure of the waste toner conveying apparatus shown in FIG. 4 is otherwise identical to that of the embodiment shown in FIG. 3 with the exception of the particular structure shown and described above.

When the solenoid 30 is energized, the output shaft 32 is extended by a predetermined distance and consequently, the shaft 10 moves longitudinally against the resilient force of the coil spring 18. When the solenoid 30 is deenergized, the shaft 10 returns to its original position due to the resilient force of the coil spring 18.

As described above, the screw 24 installed within the waste toner conveying tube **4*b* is adapted to move reciprocally and linearly along its longitudinal axis, so that any powdery toner material attached or adhered to the screw 24** can be effectively shaken off and accumulated or deposited around the toner outlet. Thus, the powdery toner can be effectively dropped through the toner outlet due to a cooperative effect of rotary and reciprocal linear motions of the screw.

I claim:

1. A waste toner conveying apparatus comprising: a housing having a waste toner outlet adjacent an end of the housing; a shaft extending longitudinally into said housing at the end thereof adjacent said outlet, the shaft being rotatably and slidably supported by said housing so as to be rotatable and axially reciprocable relative to said housing; a conveyor screw disposed within said housing and fixed to said shaft so as to be movable therewith, rotation of said conveyor screw within said housing causing waste toner within said housing to be conveyed by the screw toward said waste toner outlet; and reciprocation means operatively connected to said shaft for causing said shaft and the screw fixed thereto to reciprocate along the longitudinal axis of said shaft while said screw is rotating within said housing so as to thereby shake off any waste toner adhered to the screw as the screw conveys waste toner towards said waste toner outlet.

2. An apparatus as claimed in claim 1, wherein said reciprocation means includes a cam fixed to the end of said housing, a pin projecting from said shaft and cooperating with said cam, and a spring urging said cam and said pin into engagement.

3. An apparatus as claimed in claim 2, wherein said conveyor screw is fixed to said shaft by said pin.

4. An apparatus as claimed in claim 1, wherein said reciprocation means includes a solenoid connected to said shaft, and a spring biasing said shaft in one direction along its longitudinal axis.

* * * * *